United States Patent [19]

Noé et al.

[11] Patent Number: 4,539,830

[45] Date of Patent: Sep. 10, 1985

[54] SYSTEM FOR MAKING THIN METAL STRIP

[75] Inventors: Oskar Noé; Andreas Noé, both of Mühlheim-Ruhr; Rolf Noé, Berlin-Charlottenburg, all of Fed. Rep. of Germany

[73] Assignee: BWG Bergwerk-und Walzwerk-Maschinenbau GmbH, Duisburg, Fed. Rep. of Germany

[21] Appl. No.: 532,265

[22] Filed: Sep. 14, 1983

[30] Foreign Application Priority Data

Sep. 15, 1982 [DE] Fed. Rep. of Germany ..... 3234160

[51] Int. Cl.[3] ..... B21B 15/00; B21B 37/02; B21B 45/02; B21D 1/02

[52] U.S. Cl. ..... 72/12; 72/16; 72/128; 72/161; 72/201; 72/205

[58] Field of Search ..... 72/16, 128, 160, 161, 72/163, 201, 205, 164, 12

[56] References Cited

U.S. PATENT DOCUMENTS

| | | | |
|---|---|---|---|
| 1,048,793 | 12/1912 | Beeman et al. | 72/164 |
| 3,036,825 | 5/1962 | Eisenmenger | 266/121 |
| 3,431,761 | 3/1969 | Clement | 72/11 |
| 3,924,428 | 12/1975 | Noé | 72/205 X |
| 4,074,555 | 2/1978 | Noé | 72/128 |

FOREIGN PATENT DOCUMENTS

| | | | |
|---|---|---|---|
| 2414445 | 10/1974 | Fed. Rep. of Germany | 72/201 |
| 57-25214 | 2/1982 | Japan | 72/201 |
| 816612 | 3/1981 | U.S.S.R. | 72/160 |

*Primary Examiner*—E. Michael Combs

*Attorney, Agent, or Firm*—Karl F. Ross; Herbert Dubno

[57] ABSTRACT

A thin metal strip is made by hot-rolling a strip workpiece, stretch-bend leveling the hot-rolled strip workpiece immediately after hot-rolling it, tensioning the strip workpiece with a predetermined tension while stretch-bend leveling it, and thereafter coiling up the workpiece. In addition the workpiece is rapidly cooled immediately after stretch-bend leveling it and before coiling it up. Thus the workpiece is stretch-bend leveled before it cools so it can be treated while still about 1100° C., at which temperature it is still very plastic. The workpiece can therefore be deformed greatly while under modest tension, so as to produce a very thin product that is very uniform. The tension in the strip merely serves to keep the workpiece looped over as much an arc as possible around the stretch-bending rolls.

4 Claims, 4 Drawing Figures

SYSTEM FOR MAKING THIN METAL STRIP

FIELD OF THE INVENTION

The present invention relates to the manufacture of thin metal strip. More particularly this invention concerns an improved hot-rolling method for producing steel strip at most 1.5 mm thick and at least 600 mm wide.

BACKGROUND OF THE INVENTION

Steel strip of thicknesses less than 3 mm and widths of 600 mm to 2200 mm is one of the main products of the steel industry. Approximately two-thirds of this product is normally thinner than 1.2 mm, and this thin strip is a staple of the packaging, appliance, electronics, and automobile industries. Such thin strip can normally only be made to close tolerances, both physically and metallurgically, by cold rolling.

When an attempt is made to hot roll steel to a thickness of between 0.5 mm to 2.0 mm, or more particularly to 0.7 mm to 1.5 mm, it is normally impossible to produce a uniform cross section in the product, and to make it planar. Typically the thinnest strip that can be produced to usable tolerances is between 1.5 mm and 2.0 mm thick. Normally in widths of 600 mm to 1200 mm it is possible to make a usable product 1.8 mm thick, and even to work accurately on a regular basis to 1.5 mm thick between 600 mm and 800 mm wide. Even when subsequent cold rolling, finishing, and heating is used to improve the product, it is normally impossible to hot-roll a thinner workpiece. For instance up to six rolls have been used in a hot-rolling line to produce a workpiece between 1.0 mm and 1.2 mm thick and more than 1000 mm wide, but the results are normally of poor quality.

The problem with hot-rolling procedures is that the strip is very hard to control at the downstream end. The edges fold over or become wrinkled. Even when the workpiece is leveled by stretch bending before the last roll stand or before coiling it up, it is difficult to control it in the output stages. As the workpiece thickness decreases to the common 0.7 mm to 1.2 mm range and the width increases to the common 2200 mm level, the problems multiply.

OBJECTS OF THE INVENTION

It is therefore an object of the present invention to provide an improved system for hot-rolling a thin strip.

Another object is the provision of such a system for hot-rolling a thin strip which overcomes the above-given disadvantages, that is which can produce a workpiece of at most 1.5 mm in thickness and at least 600 mm in width which is of good planarity and uniform cross-sectional shape and thickness.

More particularly the instant invention aims at the production of thin steel strip of 0.7 mm to 1.2 mm thickness and 600 mm to 2200 mm width by an efficient hot-rolling method.

SUMMARY OF THE INVENTION

A thin metal strip according to the invention is made by hot-rolling a strip workpiece, stretch-bend leveling the hot-rolled strip workpiece immediately after hot-rolling it, tensioning the strip workpiece with a predetermined tension while stretch-bend leveling it, and thereafter coiling up the workpiece. In addition the workpiece is rapidly cooled immediately after stretch-bend leveling it and before coiling it up.

Thus according to this invention the workpiece is stretch-bend leveled immediately after hot-rolling it, not just upstream of the coiler. Indeed, stretch-bend leveling it before cooling it allows the workpiece to be treated while still about 1100° C., at which temperature it is still very plastic. The workpiece can therefore be deformed greatly while under modest tension, so as to produce a very thin product that is very uniform. Very little tension is used to maintain the width of the workpiece. Higher tension would result in a narrower product. Indeed according to this invention the tension in the strip merely serves to keep the workpiece looped over as much an arc as possible around the stretch-bending rolls.

Subsequent rapid cooling of the workpiece produces a mixed grain structure in low-carbon steels and in austenitic steels it avoids the undesirable separation of the grains. Thus it is possible to guide an extremely thin hot strip that might be as long as 150 m. Once cooled, the strip can easily be coiled up.

In fact the slight tension, coupled with the stretch bending, is effective to reduce the thickness without reducing the width. In addition the wavy areas will be subjected to limited plastic deformation so as to produce a product of almost perfect planarity.

According to another feature of this invention the strip is transversely bent immediately before, after, or even during, rapidly cooling of it.

The apparatus according to this invention comprises means including at least one roll stand for hot-rolling a strip workpiece, means for stretch-bend leveling the hot-rolled strip workpiece immediately after hot-rolling it, means for stretching the strip workpiece with a predetermined tension while stretch-bend leveling it, and means for coiling up the workpiece after leveling it. The leveling means includes a plurality of stretch rolls oppositely engageable with the strip and arranged staggered to alternate sides of it.

The leveling means according to this invention has a plurality of housings each provided with a respective drive roll, with a pair of backup rolls engaging the drive roll and themselves engaging the stretch roll, and means for pressing the drive roll against the stretch rolls and same against the stretch roll and toward the workpiece. Each housing is provided with means for spraying water against the workpiece adjacent it. The stretch rolls are accelerated until they engage the hot strip, and then are regulated to tension it.

The tensioning means of the invention includes two pairs of driven tensioning rolls pinching and displacing the workpiece and at least one transversely movable tensioning roll therebetween and displaceable against the workpiece. Means is provided for measuring the size of the workpiece downstream of the stretch-bending means and control means connected to the measuring and stretch-bending means operates the latter in accordance with the workpiece size determined by the former.

According to this invention the cooling means has at least one vessel downstream of the roll stand, aligned therewith, and formed with an upstream inlet and a downstream outlet. A bath of a liquid coolant fills the vessel to a level above the inlet and outlet openings and guides support the workpiece from the roll stands into the inlet, through the vessel, and out of the outlet thereof. Thus the workpiece is wholly immersed in and cooled by the liquid coolant within the vessel. A pump feeds fresh coolant into the vessel and withdraws hot coolant therefrom. Normally the system has a plurality of such vessels, each with a respective bath and pump means, and with all of the inlets and outlets aligned. A bending apparatus can be provided generally at, that is immediately upstream or downstream of or even in, the cooling means.

The strip according to this invention can be of the high quality produced by cold rolling, but can be made at much lower cost. Even when very thin, that is between 0.7 mm and 1.2 mm, and very wide, that is 600 mm to 2200 mm, the strip will be of perfectly uniform cross section and excellent planarity. All the strip will need is pickling and perhaps some finishing operation to be ready for use.

DESCRIPTION OF THE DRAWING

The above and other features and advantages will become more readily apparent from the following, reference being made to the accompanying drawing in which.

SPECIFIC DESCRIPTION

Figure 1:
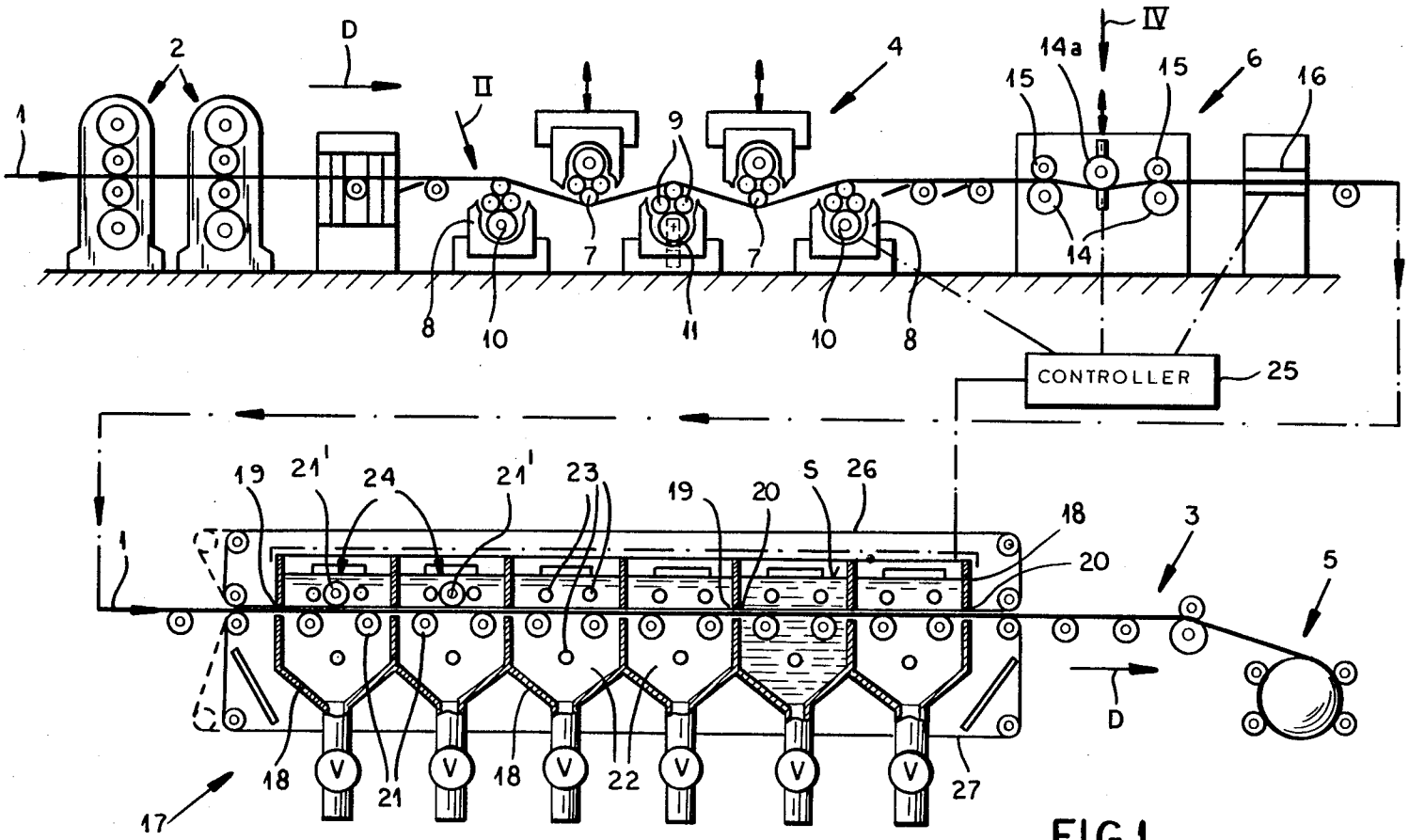
FIG. 1 is a largely schematic side view of the system of the present invention.

As seen in FIG. 1 a steel strip 1 to be reduced to at most 1.5 mm thick and at least 600 mm wide leaves the last roll stand 2 of a hot-rolling line and then passes directly into a stretch-bend leveler 4 and then into a strip stretcher 6. The strip is pulled through the system by output rolls 3 and is wound up on a coil 5.

Figure 3:
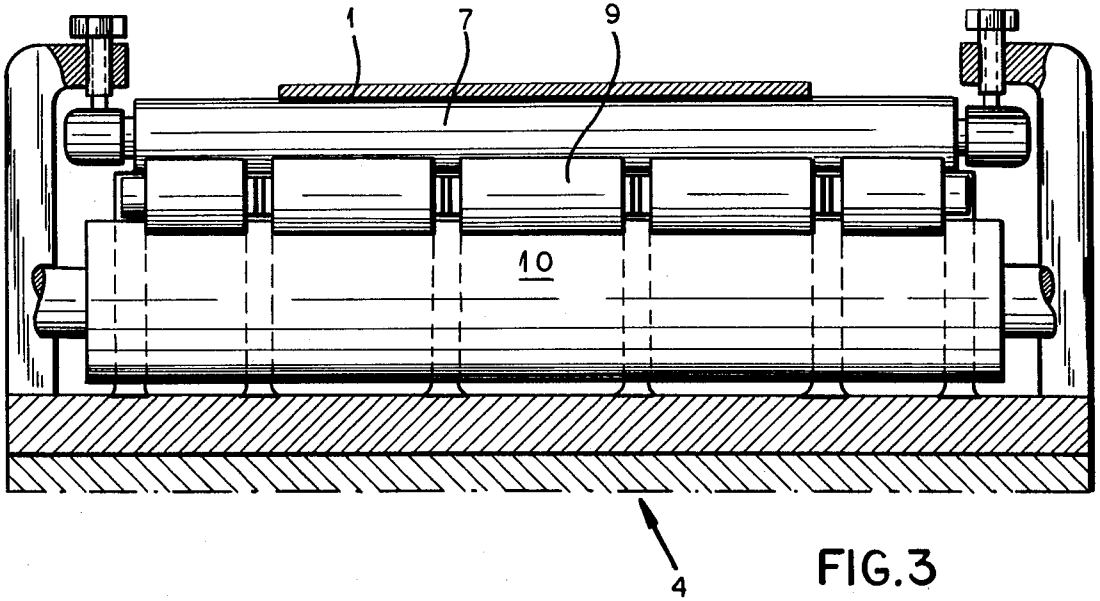
FIG. 3 is a section taken generally along line III—III of FIG. 2.
Figure 4:
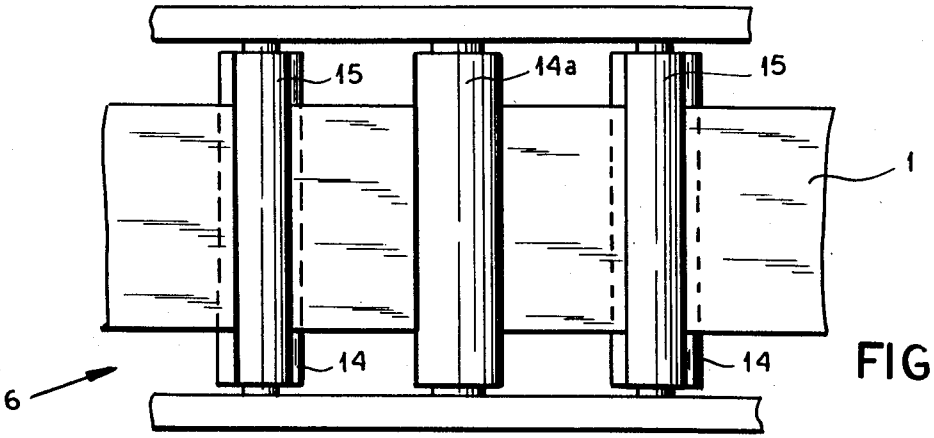
FIG. 4 is a large-scale top view taken in the direction of arrow IV of FIG. 1.
Figure 2:
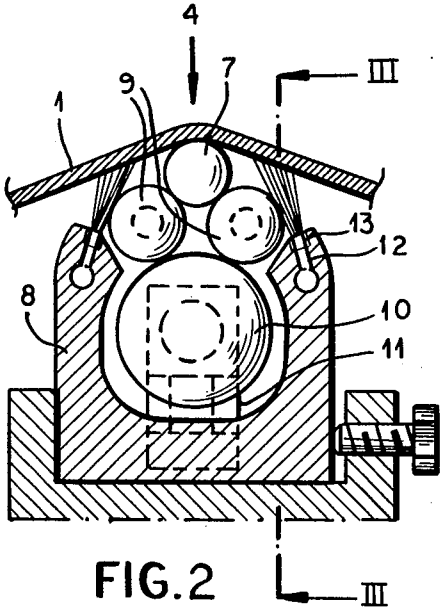
FIG. 2 is a longitudinal and vertical large-scale section of the detail indicated at II in FIG. 1.

As seen in FIGS. 2 and 3, the stretch bender 4 comprises small-diameter bending rolls 7 extending transverse to the transport direction D and each supported in a frame 8 by means of two intermediate-diameter backup rolls 9 bearing in turn on a large-diameter drive roll 10 movable vertically transverse to the direction D by an actuator 11, here a hydraulic cylinder. The frame 8 is formed to each side of the roll 7 with a water-feed channel 12 opening via nozzle holes 13 toward the workpiece 1 to spray water thereon. The actuators 11 are operated by a controller 25 in accordance with the thickness and/or width of the strip 1 as determined by a measuring apparatus 16 downstream of the stretcher/-tensioner 6.

This strip stretcher 6 comprises directly or indirectly driven tensioning rolls 14 each associated with a respective pinch roll 15. At least one central roll **14*a* is vertically displaceable perpendicular to the direction D between the rolls 14. These rolls 14 can be driven at slightly different speeds for the desired tension, and the roll 14*a* can be displaced for further small adjustments in the amount of stretch imparted to the strip 1**.

Between the measurer 16, which is immediately downstream of the tensioner 6, and the takeup rolls 3 the apparatus of this invention is provided with a cooling system 17 of the type described in our copending and jointly filed application Ser. No. 532,267, filed 9-14-83, now U.S. Pat. No. 4,534,198. This system comprises six identical vessels 18 immediately succeeding one another in the direction D. The workpiece 1 is pulled through these vessels 18 by the downstream tractor rolls 3.

Each such vessel 18 has an upstream inlet opening or slot 19 and a downstream outlet opening or slot 20. In fact a common wall between two such vessels 18 may form the outlet 20 of the upstream vessel 18 and the inlet 19 of the following vessel 18. These openings may be provided with elastic sealing lips of the type described in copending patent application Ser. No. 426,066 filed 28 Sept. 1982.

Each vessel 18 is generally subdivided by the strip 1 into an upper compartment and a lower compartment and is filled with a bath 22 of a liquid coolant, here water, to a level above the strip 1. The water is introduced into the vessels 18 by input conduits 23 having respective independently controlled valves and is withdrawn through output conduits 24, the former having mouths forming overflow openings. The output conduits 24 empty into a sump or channel connected to the intake of a cooler connected in turn to the intake of a pump whose output is connected to the conduits 23. Flow in the inlet and outlet conduits is regulated by the central computer-type controller 25 connected to temperature sensors in the separate vessels 18.

Within the vessels 18 the strip 1 is supported and held by a conveyor 21 constituted by two grooved rolls within each lower compartment and upper and lower endless openwork belts 26 and 27. These belts 26 and 27 are formed by meshes, chains, or by parallel cables. A third roll 21' can be provided to form a stretch/bend leveler right in each of the vessels 18.

This arrangement ensures thorough and even wetting and uniform cooling of the workpiece 1 in a relatively short space, producing good grain structure.

We claim:

1. A method of making thin steel strip, the method comprising the steps of:

hot-rolling a strip workpiece to a thickness of at most 1.5 mm, a width of at least 600 mm, full plasticity, and a temperature of about 1100° C.;

stretch-bend leveling the hot-rolled strip workpiece immediately after hot-rolling it and while the workpiece is still about 1100° C. and very plastic;

measuring the width and thickness of the strip workpiece;

tensioning the strip workpiece with a predetermined tension while stretch-bend leveling it in accordance with the measured width and thickness of the strip;

rapidly cooling the workpiece immediately after stretch-bend leveling it; and thereafter coiling up the workpiece.

2. The strip-making method defined in claim 1 further comprising the step of:

transversely bending the strip immediately before rapidly cooling it.

3. The strip-making method defined in claim 1 further comprising the step of:

transversely bending the strip immediately after rapidly cooling it.

4. The strip-making method defined in claim 1 wherein the tension applied to the strip as it is being stretch-bend leveled is insufficient to reduce its width.

* * * * *